US009180997B2

(12) United States Patent
Melistas

(10) Patent No.: US 9,180,997 B2
(45) Date of Patent: Nov. 10, 2015

(54) MULTI-TIERED CONTAINER

(71) Applicant: George Melistas, Eastpointe, MI (US)

(72) Inventor: George Melistas, Eastpointe, MI (US)

( * ) Notice: Subject to any disclaimer, the term of this patent is extended or adjusted under 35 U.S.C. 154(b) by 0 days.

(21) Appl. No.: 14/511,618

(22) Filed: Oct. 10, 2014

(65) Prior Publication Data

US 2015/0102093 A1 Apr. 16, 2015

Related U.S. Application Data

(60) Provisional application No. 61/889,691, filed on Oct. 11, 2013.

(51) Int. Cl.
*B65D 5/488* (2006.01)
*B65D 5/50* (2006.01)
*B65D 5/48* (2006.01)

(52) U.S. Cl.
CPC ..... *B65D 5/5016* (2013.01); *B65D 5/48014* (2013.01); *B65D 5/48018* (2013.01); *B65D 5/5021* (2013.01); *B65D 2585/366* (2013.01)

(58) Field of Classification Search
CPC ..... B65D 5/5016; B65D 5/5021; B65D 5/48014; B65D 5/48018; B65D 2585/366
USPC ..... 229/120.21, 902, 906, 114, 146, 149, 229/150
See application file for complete search history.

(56) References Cited

U.S. PATENT DOCUMENTS 2,619,276 A * 11/1952 Gibbons ..... 229/146
2,850,224 A 9/1958 Meinhardt et al.
3,013,710 A * 12/1961 Kronson et al. ..... 229/117.07
3,043,487 A 7/1962 Fowle
3,095,086 A 6/1963 Berg
3,211,359 A 10/1965 Fickes
3,306,520 A * 2/1967 Allard ..... 229/149
3,516,596 A * 6/1970 Madden et al. ..... 206/521.1
3,565,326 A * 2/1971 Turkovich ..... 229/120.32
D244,833 S 6/1977 Persson
4,105,155 A 8/1978 Forbes, Jr.
4,232,816 A 11/1980 Johnson et al.
4,237,171 A 12/1980 Laage et al.
4,355,757 A 10/1982 Roccaforte
4,441,626 A 4/1984 Hall
4,498,420 A 2/1985 Botterman et al.
4,650,075 A 3/1987 Grazia
4,836,383 A 6/1989 Gordon et al.
4,944,452 A * 7/1990 Kent et al. ..... 229/120.21
4,957,237 A * 9/1990 Madonna et al. ..... 229/120
5,002,221 A 3/1991 Ragan
5,049,710 A 9/1991 Prosise et al.
5,226,532 A 7/1993 Davidson et al.
5,351,880 A 10/1994 Goudreau (Continued)

*Primary Examiner* — Gary Elkins
(74) *Attorney, Agent, or Firm* — Gregory L. Ozga; Warn Partners, P.C.

(57) ABSTRACT

The present invention is directed to a container, forming a multi-tiered container when folded from a flat planar blank. The container includes a top having a planar top surface, a top front side, a top left side, a top right side, and a top back side. The container also includes a bottom having a planar bottom surface, a bottom front side, a bottom left side, a bottom right side, and a bottom back side. A horizontal opening edge extends parallel to the planar top surface and the planar bottom surface. The horizontal opening edge divides and separates the top from the bottom, more specifically, the top front side from the bottom front side, the top left side from the bottom left side, and the top right side from the bottom right side.

15 Claims, 20 Drawing Sheets

(56) References Cited

U.S. PATENT DOCUMENTS

| | | | | |
|---|---|---|---|---|
| 5,445,314 | A * | 8/1995 | Newsome | 229/120.21 |
| D362,803 | S | 10/1995 | McMullen | |
| 5,568,877 | A | 10/1996 | Rench | |
| D376,759 | S | 12/1996 | Bradfield | |
| 5,772,110 | A | 6/1998 | Garretson | |
| 5,803,267 | A | 9/1998 | Tu et al. | |
| 5,911,320 | A | 6/1999 | Forestelle | |
| 5,938,109 | A | 8/1999 | Sainz et al. | |
| 5,950,912 | A | 9/1999 | Economopoulos | |
| 6,527,123 | B1 | 3/2003 | Ausaf | |
| 6,752,311 | B2 | 6/2004 | Tulkoff | |
| 6,781,101 | B1 | 8/2004 | Hoese et al. | |
| 6,851,601 | B1 | 2/2005 | Montoya | |
| 6,915,949 | B1 | 7/2005 | Economopoulos | |
| D511,681 | S | 11/2005 | Cogley et al. | |
| D516,905 | S | 3/2006 | Cogley et al. | |
| D553,979 | S | 10/2007 | North | |
| 7,464,855 | B2 | 12/2008 | Glasgow | |
| 7,607,565 | B2 | 10/2009 | Noguchi | |
| 7,661,578 | B2 | 2/2010 | Li | |
| D649,040 | S | 11/2011 | Sanders | |
| D652,294 | S | 1/2012 | Seneca et al. | |
| D665,665 | S | 8/2012 | Seneca et al. | |
| 8,365,981 | B1 | 2/2013 | Perlsweig | |
| D681,452 | S | 5/2013 | Dennen et al. | |
| D682,680 | S | 5/2013 | Terlesky | |
| D683,213 | S | 5/2013 | Clegg | |
| D683,624 | S | 6/2013 | Terlesky et al. | |
| D690,591 | S | 10/2013 | Sanders et al. | |
| 1,093,412 | A1 | 4/2014 | Hess | |
| 8,770,466 | B1 | 7/2014 | Terlesky et al. | |
| 2003/0062406 | A1 | 4/2003 | Lizzo | |
| 2004/0079795 | A1 | 4/2004 | Wagner | |
| 2004/0108370 | A1 | 6/2004 | Lee | |
| 2005/0150938 | A1* | 7/2005 | Correll | 229/120.15 |
| 2006/0097032 | A1 | 5/2006 | Kanamore et al. | |
| 2007/0194093 | A1* | 8/2007 | Ford | 229/144 |
| 2007/0290026 | A1 | 12/2007 | Kastanek et al. | |
| 2009/0140032 | A1 | 6/2009 | Cai et al. | |
| 2009/0172872 | A1 | 7/2009 | Macey et al. | |
| 2011/0233264 | A1 | 9/2011 | Lombardi et al. | |
| 2011/0272411 | A1 | 11/2011 | Sanders | |
| 2012/0111931 | A1 | 5/2012 | Kimhi | |
| 2013/0284798 | A1 | 10/2013 | D'Amato | |

* cited by examiner

MULTI-TIERED CONTAINER

CROSS-REFERENCE TO RELATED APPLICATIONS

This application claims the benefit of U.S. Provisional Application No. 61/889,691 filed Oct. 11, 2013.

FIELD OF THE INVENTION

The present invention relates to a multi-tiered container design for pizza and other foods.

BACKGROUND OF THE INVENTION

There are basically two ways of packaging large size pizzas. One is a square box, usually about 15 inches square and 1¾ inches deep. The other way is cardboard tray with two large pizzas carried side by side thereon which are slid into a paper bag. Both of these packages are difficult and awkward to handle, and hard to negotiate through doorways. Also, the large pizza box is so large it is difficult to fold and discard into a conventional size trash can, difficult to put in a refrigerator, and difficult to fit into a standard microwave oven.

SUMMARY OF THE INVENTION

The present invention is directed to a container, forming a multi-tiered container when folded from a flat planar blank. The container includes a top having a planar top surface, a top front side, a top left side, a top right side, and a top back side. The container also includes a bottom having a planar bottom surface, a bottom front side, a bottom left side, a bottom right side, and a bottom back side. A horizontal opening edge extends parallel to the planar top surface and the planar bottom surface. The horizontal opening edge divides and separates the top from the bottom, more specifically, the top front side from the bottom front side, the top left side from the bottom left side, and the top right side from the bottom right side. The container also has a back side horizontal fold extending longitudinally across and creating a fold line between the top back side and the bottom back side of the container. The container also includes a locking tab formed on the top left side that extends downward and is received by an aperture formed on the bottom left side. There is also a locking tab formed on the top right side and extends downward and is received in an aperture formed on the bottom right side. The locking tab on the top left side and the locking tab on the top right side hold the top to the bottom when the container is in the closed position. Both locking tabs each have a neck portion and a wing portion. The wing portion is wider than the neck portion and when the respective locking tab is placed within its respective aperture, each wing portion locks the top to the bottom by passing through the respective aperture and resting laterally below the aperture.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Referring now to the invention in more detail, in FIGS. 1-11 show various views of a container 10 in accordance with one embodiment of the present invention. When the container 10 is folded it creates a multi-tiered container. While the present embodiment of the invention is referred to as a container 10, it is within the scope of this invention for the container 10 to be used generally as a take-out container for any type of food including but not limited to pizza, pastries, pasta, meat and produce. It is also within the scope of this invention for the container 10 to be used for carrying or storing other articles in its compartments. The container 10 is made of any type of material from which a blank can be created that will allow the container to folded from an unfolded position to a folded position. In one embodiment of the invention the container 10 is made from cardboard; however it is possible to make the container out of other materials.

Figure 11:
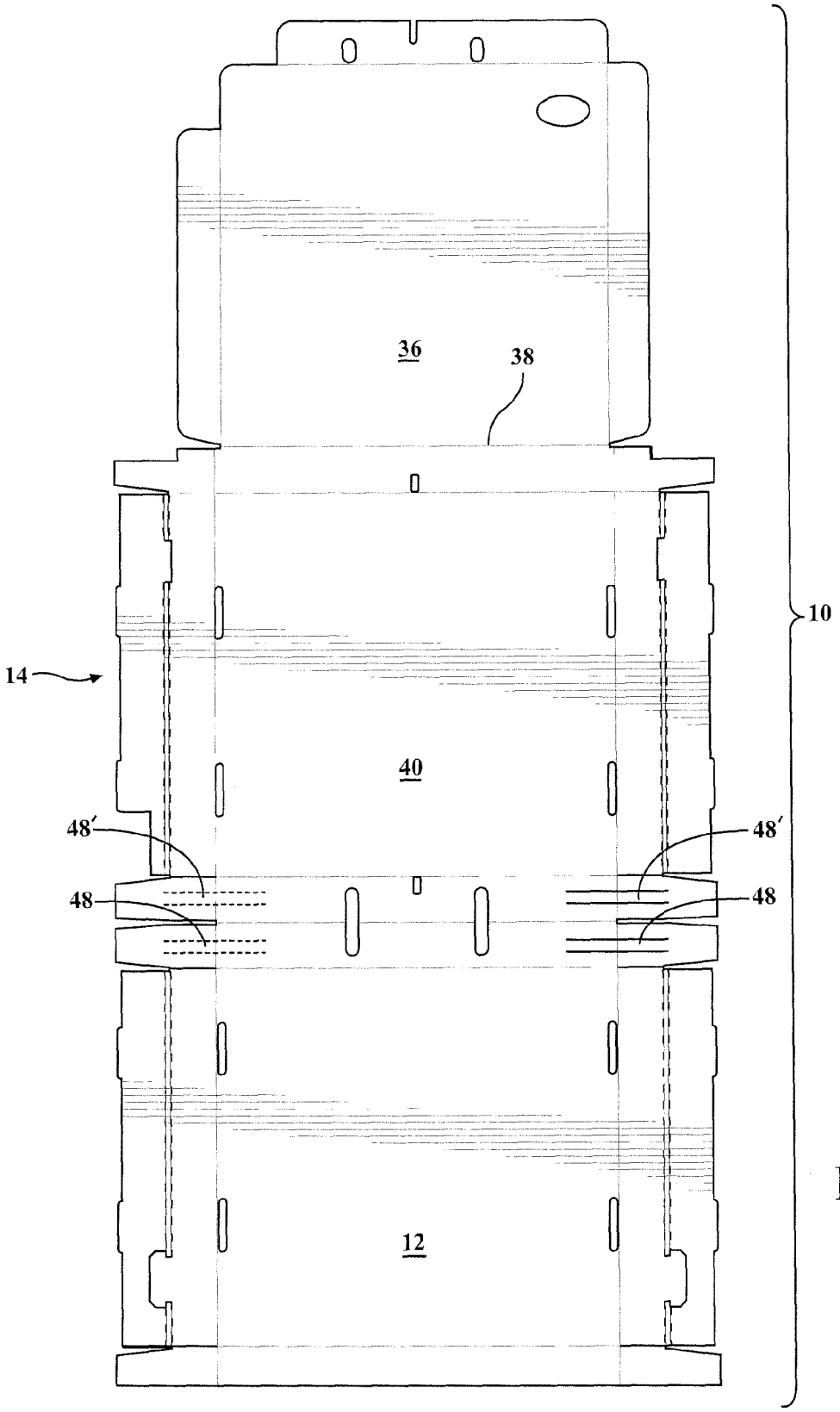
FIG. 11 is an overhead plan view of an unfolded blank of the container according to one embodiment of the present invention.

FIGS. 1-10 show the container in a folded position, while FIG. 11 shows the container 10 in its unfolded or blank state. The folded container 10 when fully closed has a generally square shape with a top 12, bottom 14, top front side 16*a*, bottom front side 16*b*, top back side 18*a*, bottom back side 18*b*, top left side 20*a*, bottom left side 20*b* and top right side 22*a*, bottom right side 22*b*. A horizontal open edge 24 that extends parallel to the top 12 and bottom 14 planar surfaces. The horizontal open edge 24 also divides and separates the top front side 16*a* from the bottom front side 16*b*, the top left side 20*a* from bottom left side 20*b*, and the top right side 22*a* from bottom right side 22*b*. A back side horizontal fold 26 extends longitudinally across and creates a fold line between the top back side 18*a* and the bottom back side 18*b*.

The top left side 20*a* and top right side 22*a* each have a locking tab 28 configured to align with and slide into a respective aperture 30 formed on bottom left side 20*b* and bottom right side 22*b*. It is within the scope of this invention for each locking tab 28 to be located on the bottom left side of 20*b* and bottom right side of 22*b*, when respective aperture 30 formed on top left side 20*a* and top right side 22*a*. A locator tab 32 extends upward from each of the edges of apertures 30 on the bottom left side 20*b*, bottom right side 22*b* and function to align the top 12 with the bottom 14, when the container 10 is closed. The locator tabs 32 are also positioned within recesses 34 formed on the inside surface of top 12 of the container, which confirms alignment of the top 12 and bottom 14 when the container is closed. The locator tabs 32 also align partially parallel and partially abut against the locking tabs 28 when the container 10 is closed, which provides support to the structure of the container 10 by increasing the thickness of the container in the region of the locking tabs 28 and locator tabs 32.

Between the top 12 and bottom 14 and contained within the container 10 is a horizontal divider 36 that is connected the bottom front side 16*b*. The horizontal divider 36 folds along a horizontal divider fold line 38 formed between the bottom front side 16*b* of the box and the horizontal divider 36. When folded along the horizontal divider fold line 38 the horizontal divider 36 extends over, above and parallel to a bottom inside surface 40 of the container. It also within the scope of this invention for the horizontal divider fold line 38 to include a pull tab 42 feature extending along horizontal divider fold line 38, which allows the horizontal divider 36 to be separated from the container 10 when the pull tab 42 is pulled and removed. The bottom inside surface 40 of the container and the horizontal divider 36 provide surfaces for placing two tiers of items. For example a first pizza can be placed on the bottom inside surface 40 and a second pizza can be placed above on the horizontal divider 36 once folded into position over the bottom inside surface 40. The top 12 of the container 10 is then folded down to the closed position covering the horizontal divider 36. The top 12 is located and held in place with the locking tabs 28 and locator tabs 32 described above.

FIG. 11 shows a flat blank that is the unfolded container in accordance with the present embodiment of the invention. The blank has several fold lines that are used to fold the various sides and portions of the container 10.

Referring now to the locking tabs 28, each locking tab 28 has a neck portion 44 and a wing portion 46. The wing portion 46 is wider than the neck portion 44 and the respective aperture 30 to which the locking tab 28 slides into. During closing of the container 10, the top 12 can be locked to the bottom 14 using the locking tabs 28 found on the top left side 20*a* and top right side 22*a*. During closing, the top 12 can be bent allowing the wing portion 46, which is wider than the aperture 30, to slide at an angle into the respective aperture 30 thereby allowing the wing portion 46 to lock the top 12 to the bottom 14 by passing through the respective aperture 30 and resting laterally below the aperture 30.

Figure 1:
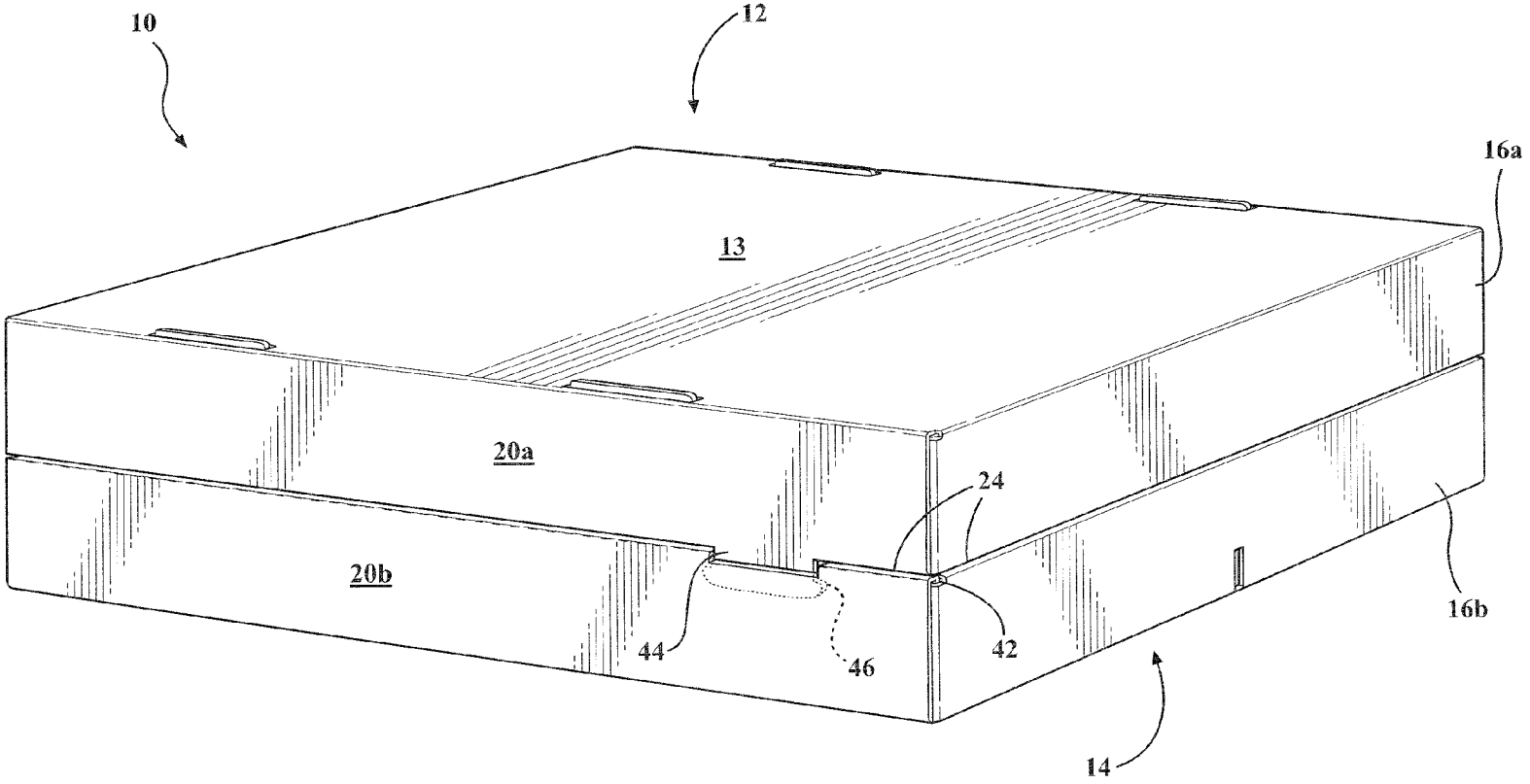
FIG. 1 is an angled side perspective view of a closed container according to one embodiment of the present invention.
Figure 2:
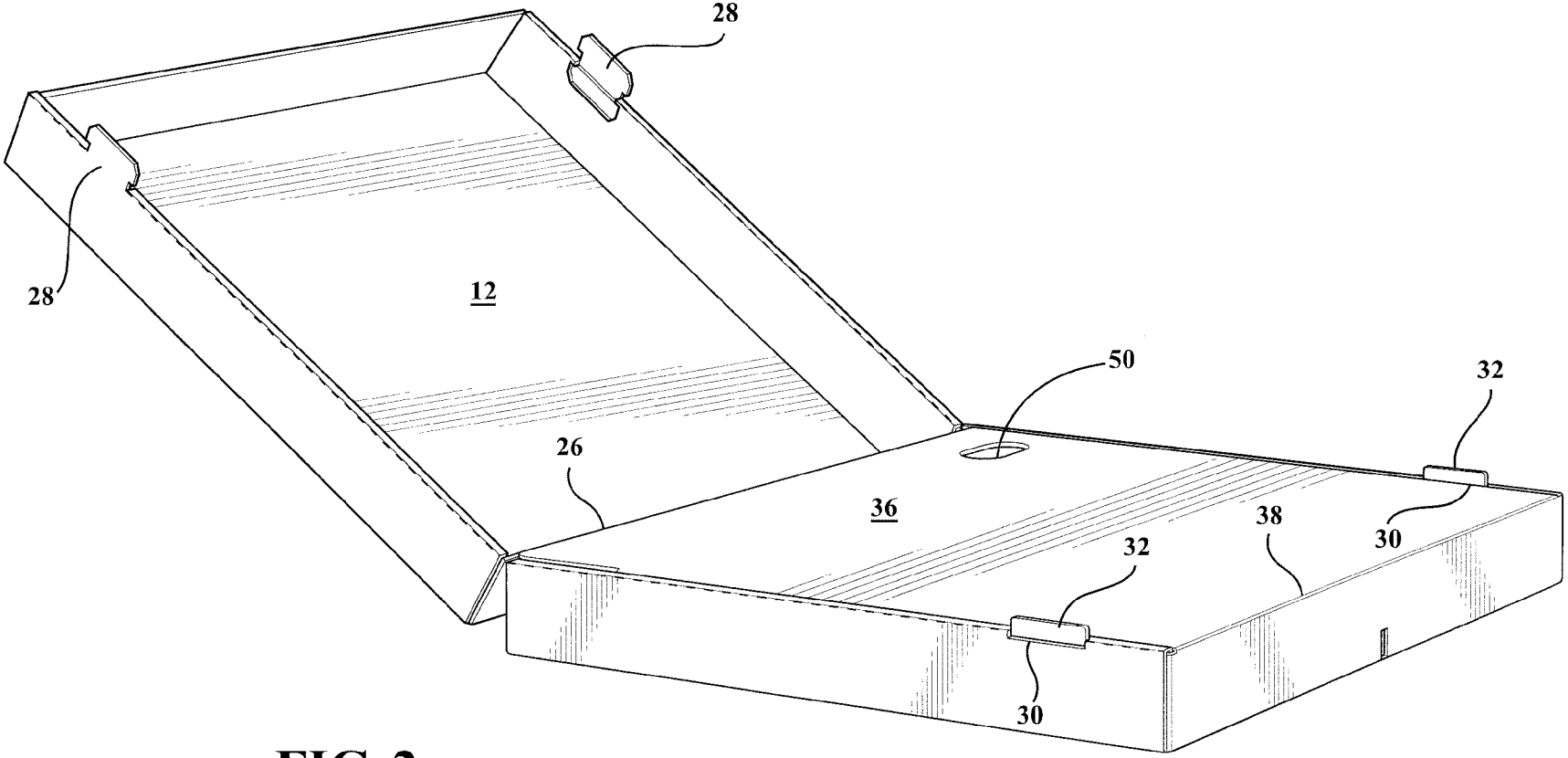
FIG. 2 is an angled side perspective view of an open container showing a horizontal divider creating a top layer according to one embodiment of the present invention.

Referring to FIG. 2, the horizontal divider 36 has a thumb hole 50 formed in the horizontal divider that allows a user of the container to move the horizontal divider 36 about the horizontal divider fold line 38 using the thumb hole 50.

Figure 3:
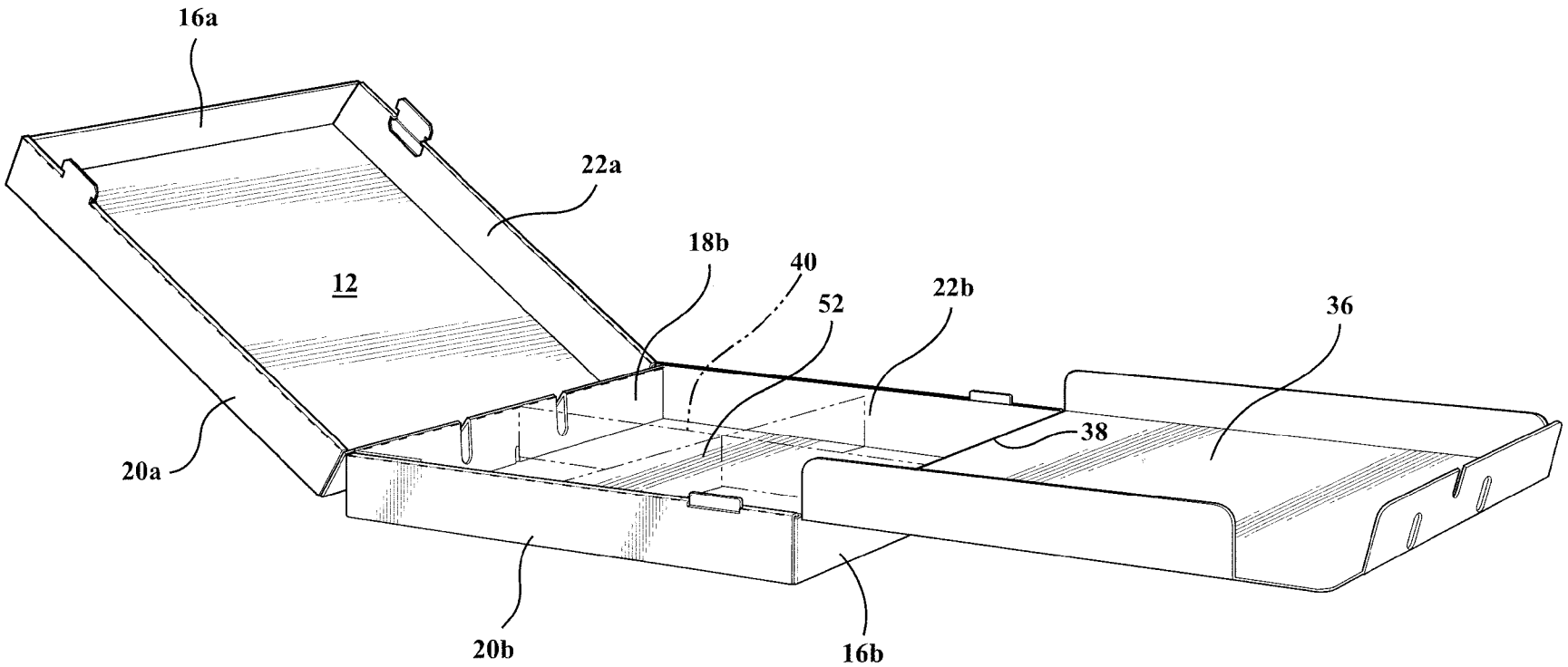
FIG. 3 is an angled side perspective view of an open container with the horizontal divider opened to show the bottom layer according to one embodiment of the present invention.

In another alternate embodiment of the invention shown in FIG. 3, there is a divider 52 positionable on the bottom inside surface 40 that divides the bottom inside surface 40 into sections. This allows for the bottom inside surface 40 to be used for placing different items of varying sizes and keeping them contained within their specific section. The divider 52 may be a separate piece that is inserted onto the bottom surface 40 or it may be connected to the bottom surface 40 and is foldable vertically upward from the bottom surface 40.

Referring now to the invention in more detail, in FIGS. 11-20 a second embodiment of a container box 100 is shown. The container box 100 is used generally as a take-out container for any type of food including but not limited to pizza, pastries, pasta, meat and produce. It is also within the scope of this invention for the container 100 to be used for carrying or storing other articles in its compartments. The container 100 is made of any type of material from which a blank can be created that will allow the container to folded from an unfolded position to a folded position. In one embodiment of the invention the container 100 is made from cardboard.

Figure 12:
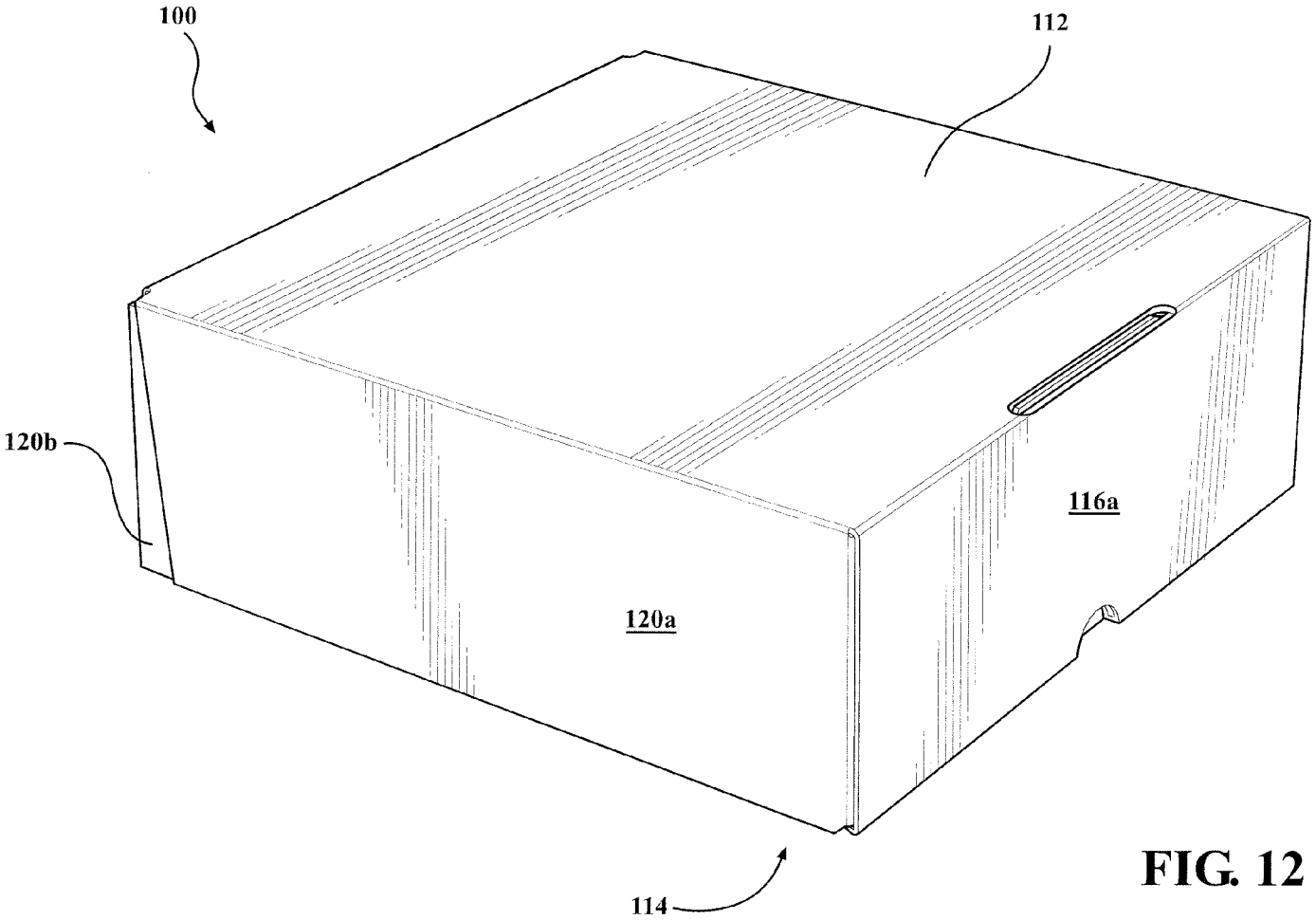
FIG. 12 is an angled side perspective view of a closed double container according to a third embodiment of the invention.
Figure 13:
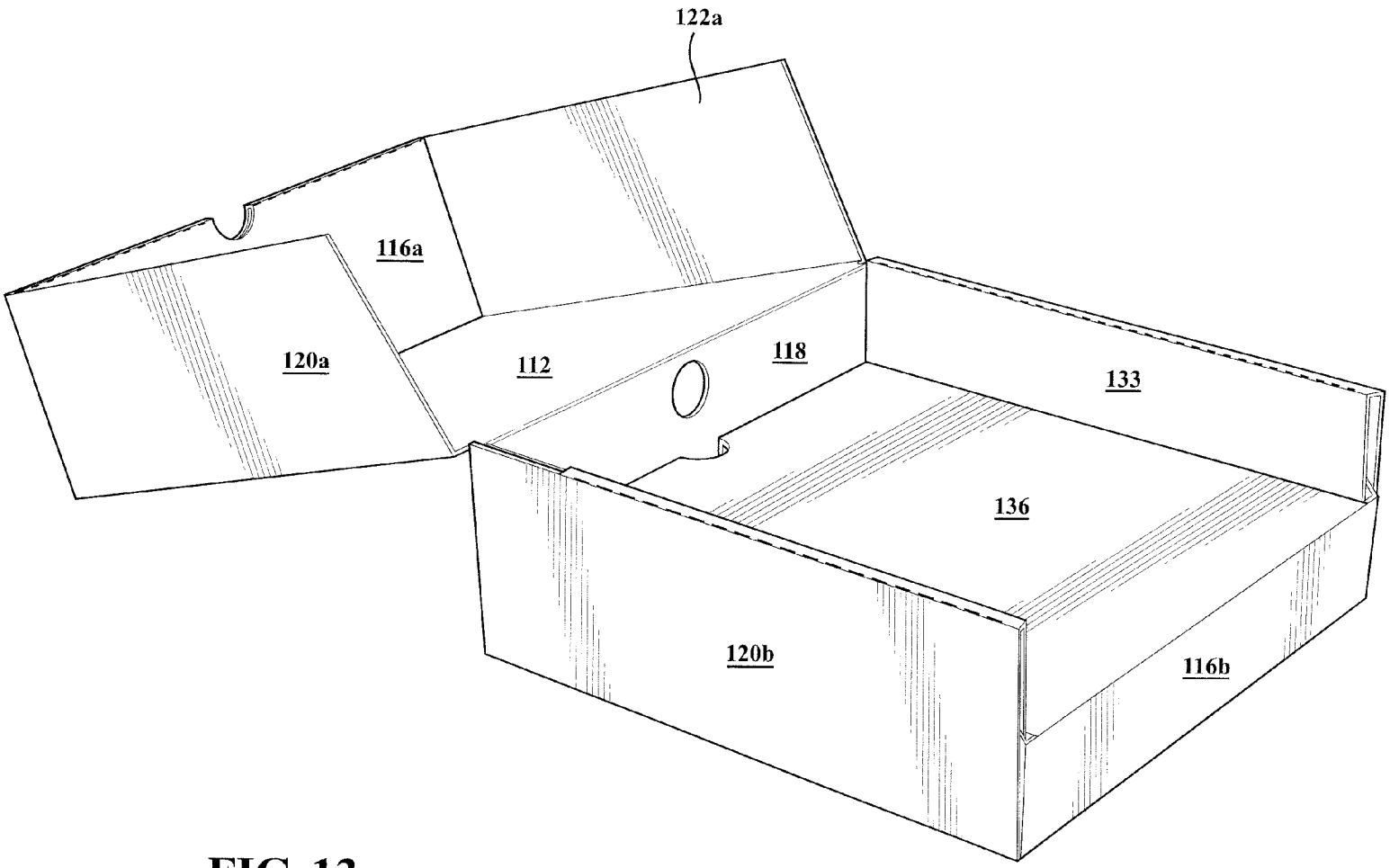
FIG. 13 is an angled side perspective view of an open container showing a horizontal divider creating a top layer according the second embodiment of the invention.
Figure 14:
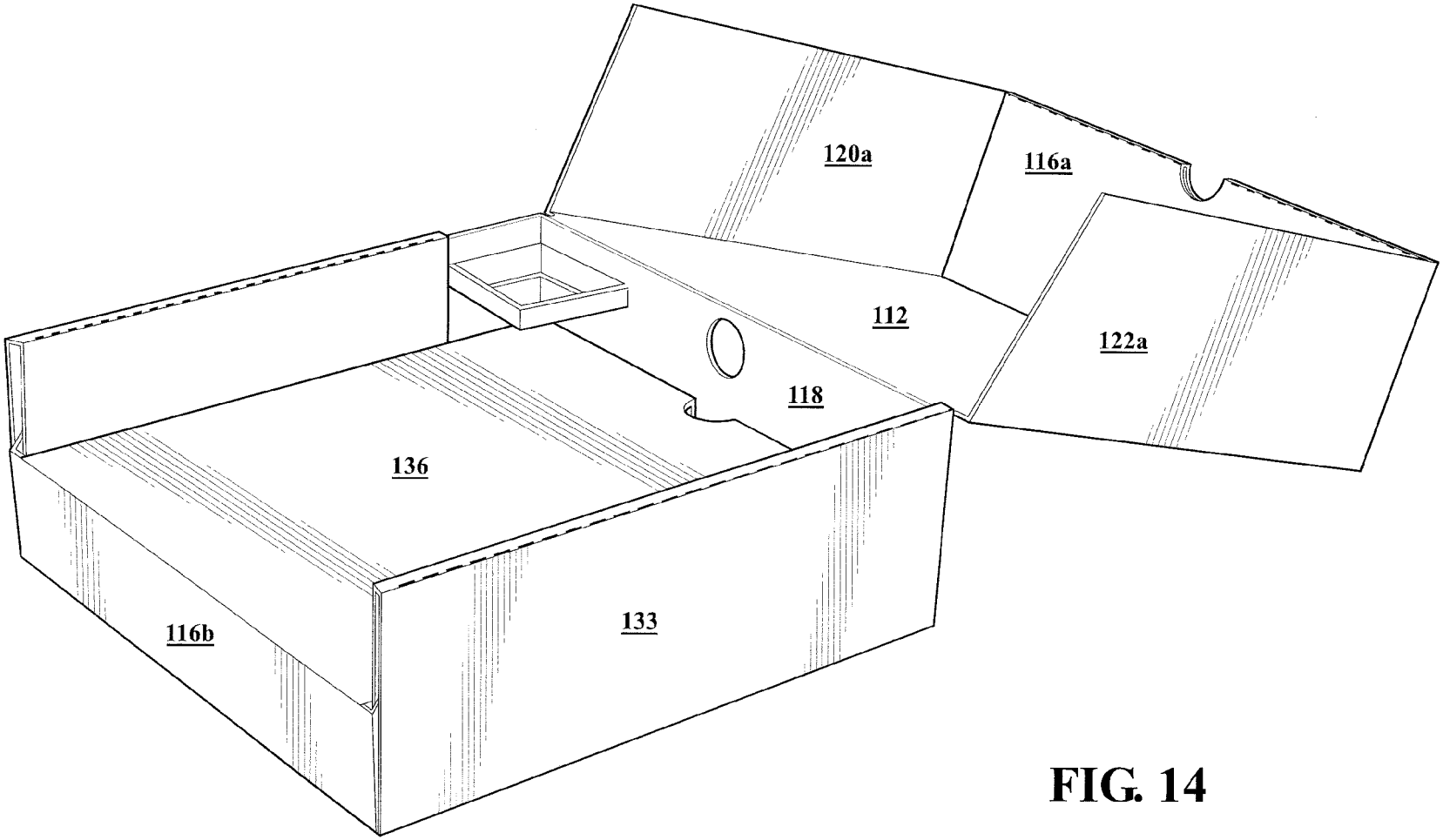
FIG. 14 is an angled side perspective view of an open container with a corner divider folded out and a horizontal divider creating a top layer according the second embodiment of the invention.
Figure 15:
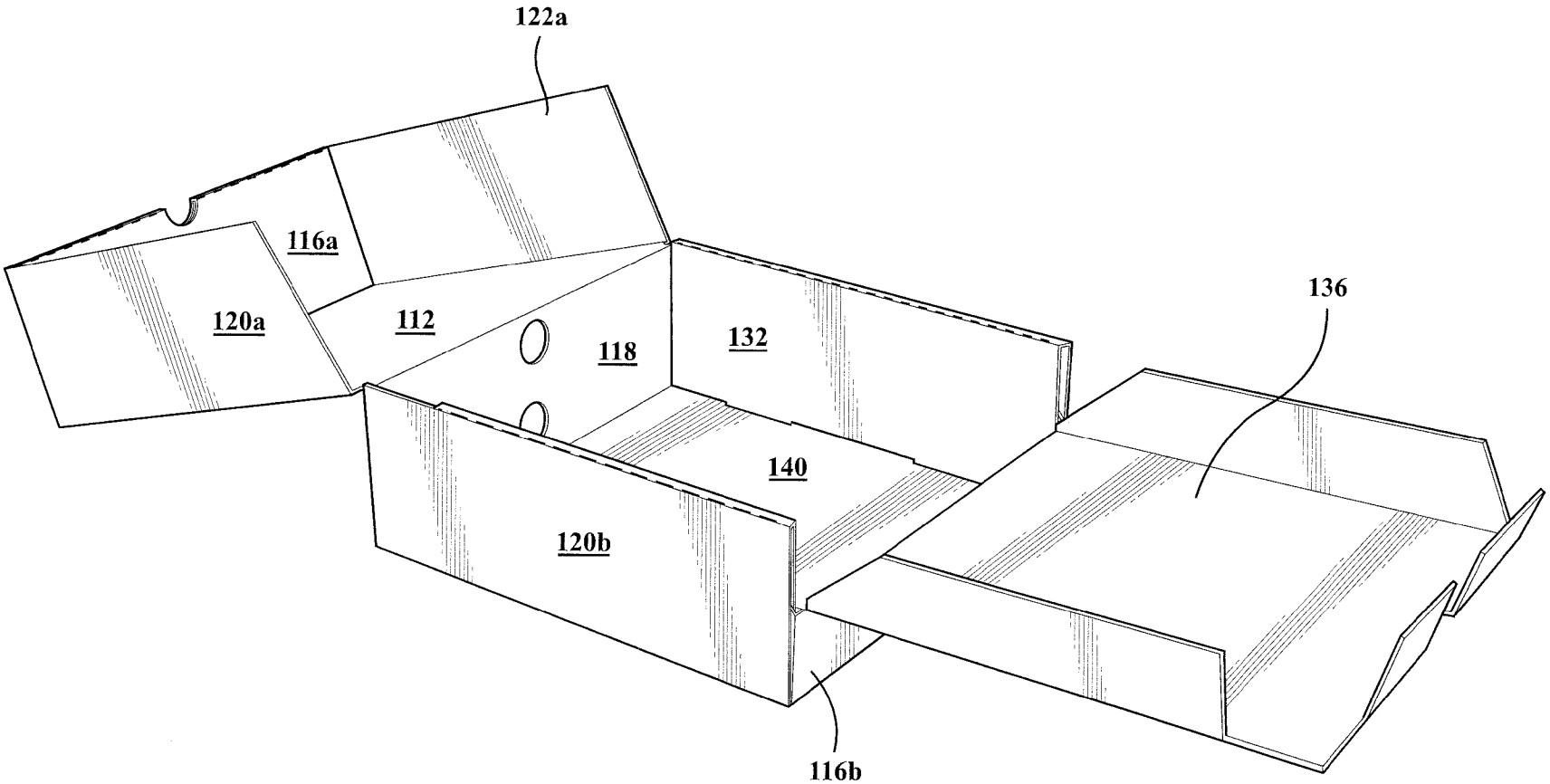
FIG. 15 is an angled side perspective view of an open container with the horizontal divider opened to show the bottom layer according to the second embodiment of the invention.
Figure 20:
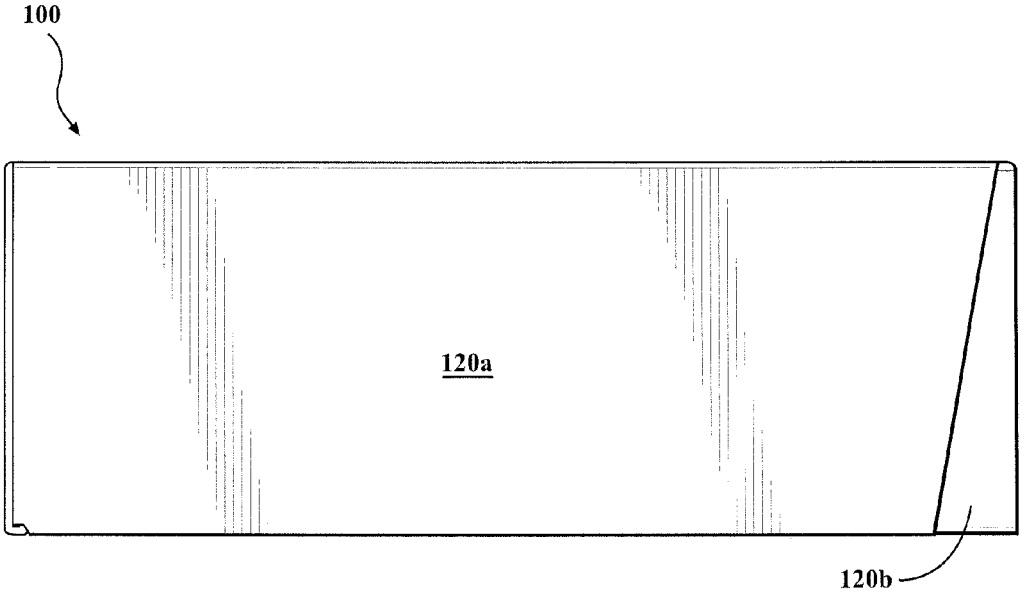
FIG. 20 is a right side plan view of the closed container according to the second embodiment of the invention.
Figure 21:
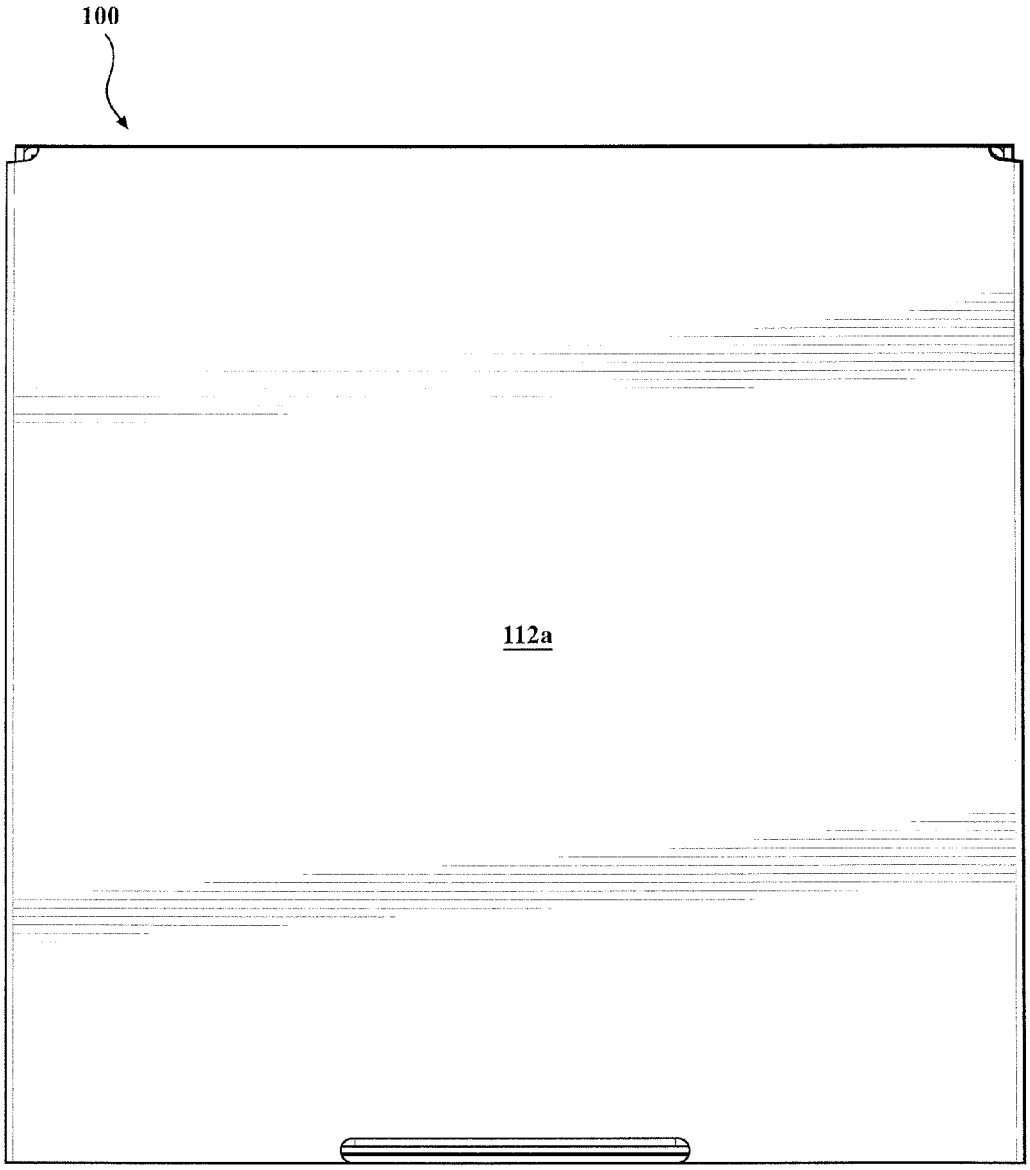
FIG. 21 is a top side plan view of the closed container according to the second embodiment of the invention.
Figure 22:
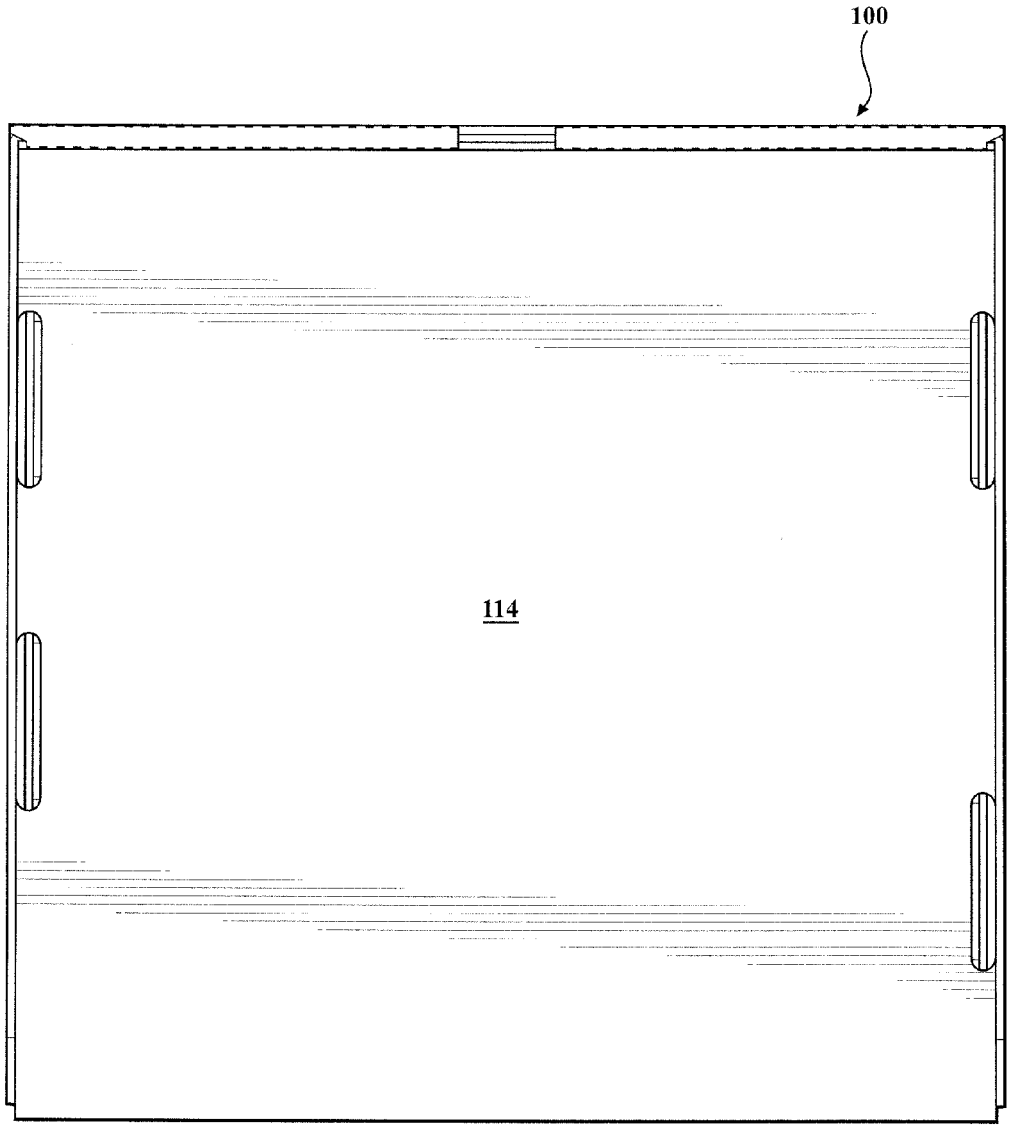
FIG. 22 is a bottom side plan view of the closed container according to the second embodiment of the invention.

FIGS. 12-24 show the container in a folded position, while FIG. 20 shows the container 100 in its unfolded or blank state. The folded container 100 when fully closed has a generally square shape with a top 112, bottom 114, top front side 116*a*, bottom front side 116*b*, back side 118, top left side 120*a*, bottom left side 120*b* and top right side 122*a*, bottom right side 122*b*. In this particular embodiment of the invention the top front side 116*a*, top left side 120*a* and top right side 122*a* extend over the respective bottom front side 116*b*, bottom left side 120*b* and bottom right side 122*b* when the contained 100 is the closed position. A back side horizontal fold 26 extends longitudinally across the top of the back side 118 of the container 100 and allows the top 112 of the container 100 to fold open as shown in FIGS. 12 and 13.

Compartment walls 132, which are connected to and part of bottom left side 120*b* and bottom right side 122*b* are perpendicular to the inside surface of the back side 118 create a three walled, opened ended compartment when a horizontal divider 136 is folded in the closed position. The horizontal divider 136 is positioned between the top 112 and bottom 114 and folds along a horizontal divider fold line 138 formed between the bottom front side 116*b* of the box and the horizontal divider 136. The horizontal divider 36 extends over, above and parallel to a bottom inside surface 140 of the container 100. It also within the scope of this invention for the horizontal divider fold line 138 to include a pull-tab feature that allows the horizontal divider to be separated from the container 100 when the pull-tab is pulled, which removes the connection of the horizontal divider 136 to the container 100. The bottom inside surface 140 of the container and the horizontal divider 136 provide surfaces for placing two tiers of items. For example a first pie can be placed on the bottom inside surface 140 and a second pie can be placed above on the horizontal divider 136 once folded into position over the bottom inside surface 140. The top 112 of the container 100 is then folded down to the closed position covering the horizontal divider 136.

Figure 4:
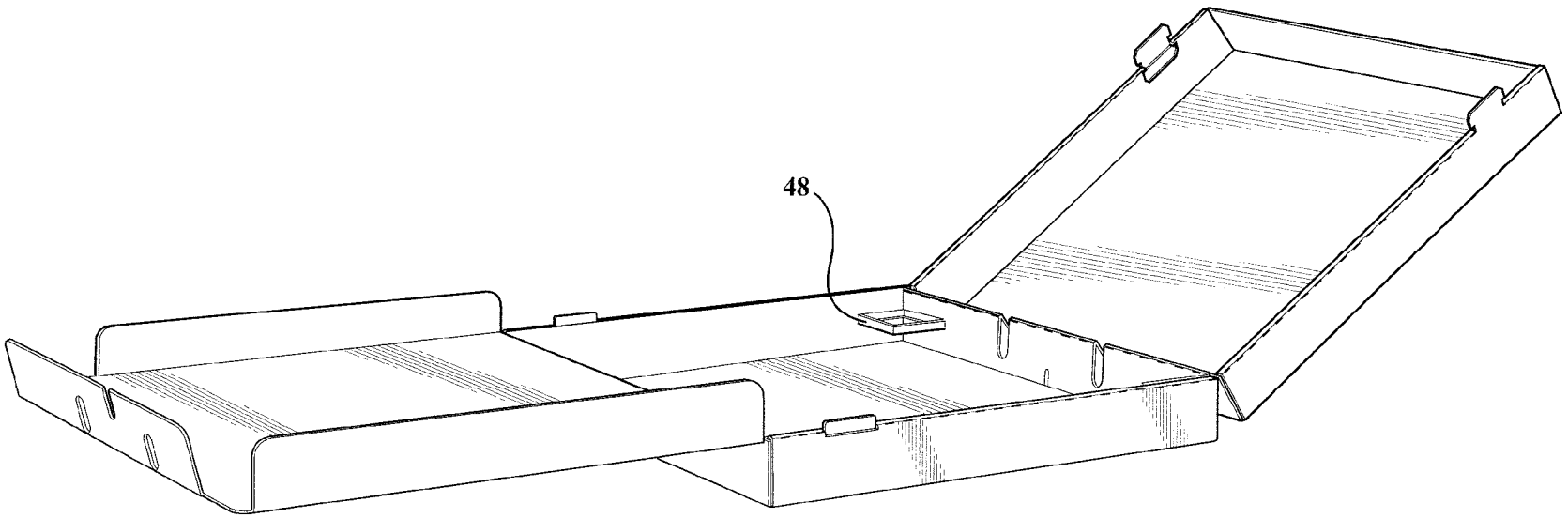
FIG. 4 is an angled side perspective view of an alternate embodiment of the invention, wherein the container is shown with the horizontal divider opened, showing the bottom layer with a corner divider folded out.
Figure 5:
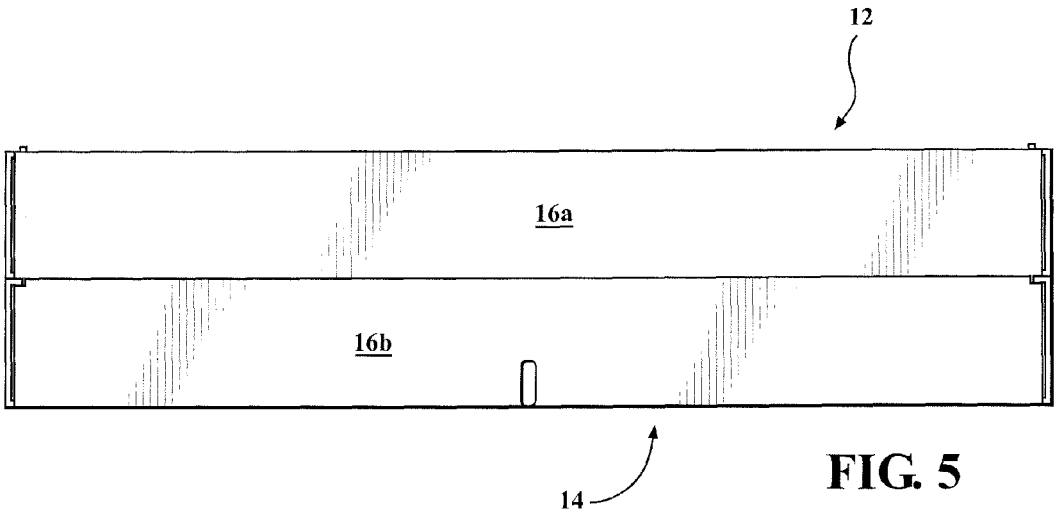
FIG. 5 is a front side plan view of the closed container according to one embodiment of the present invention.
Figure 6:
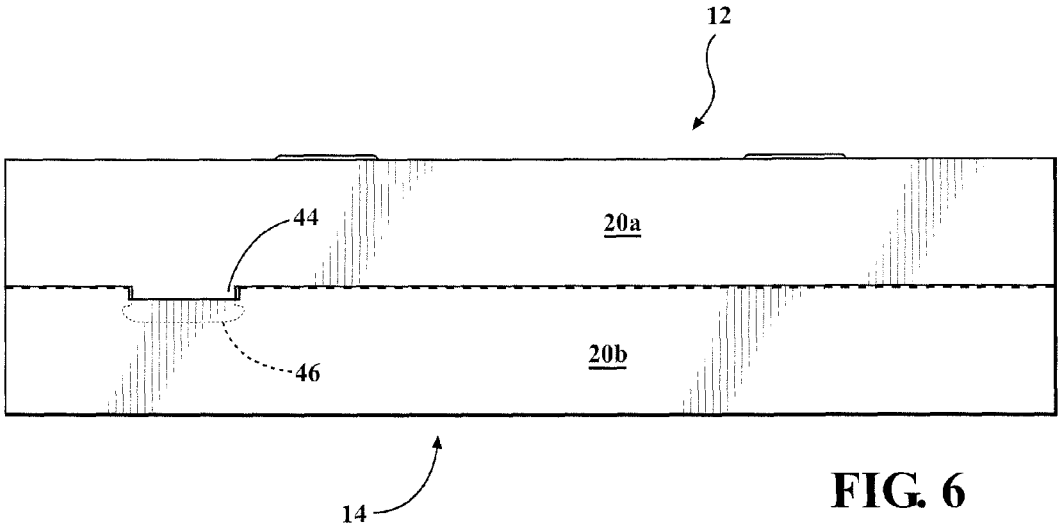
FIG. 6 is a left side plan view of the closed container according to one embodiment of the present invention.
Figure 7:
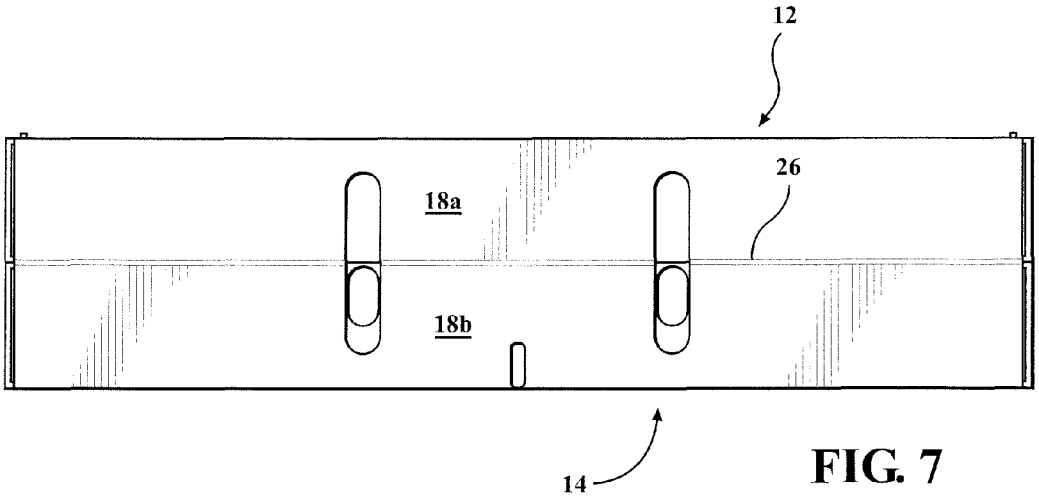
FIG. 7 is a rear side plan view of the closed container according to one embodiment of the present invention.
Figure 8:
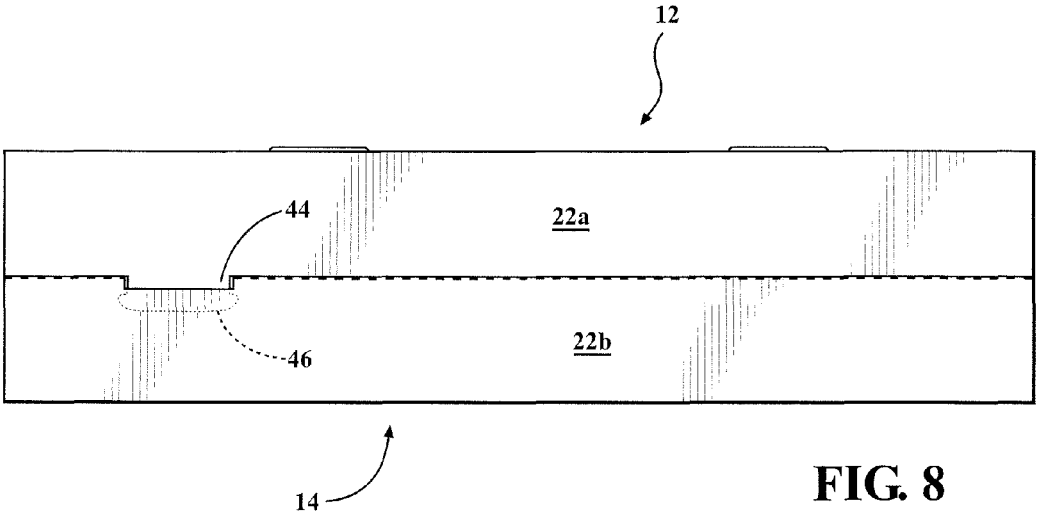
FIG. 8 is a right side plan view of the closed container according to one embodiment of the present invention.
Figure 9:
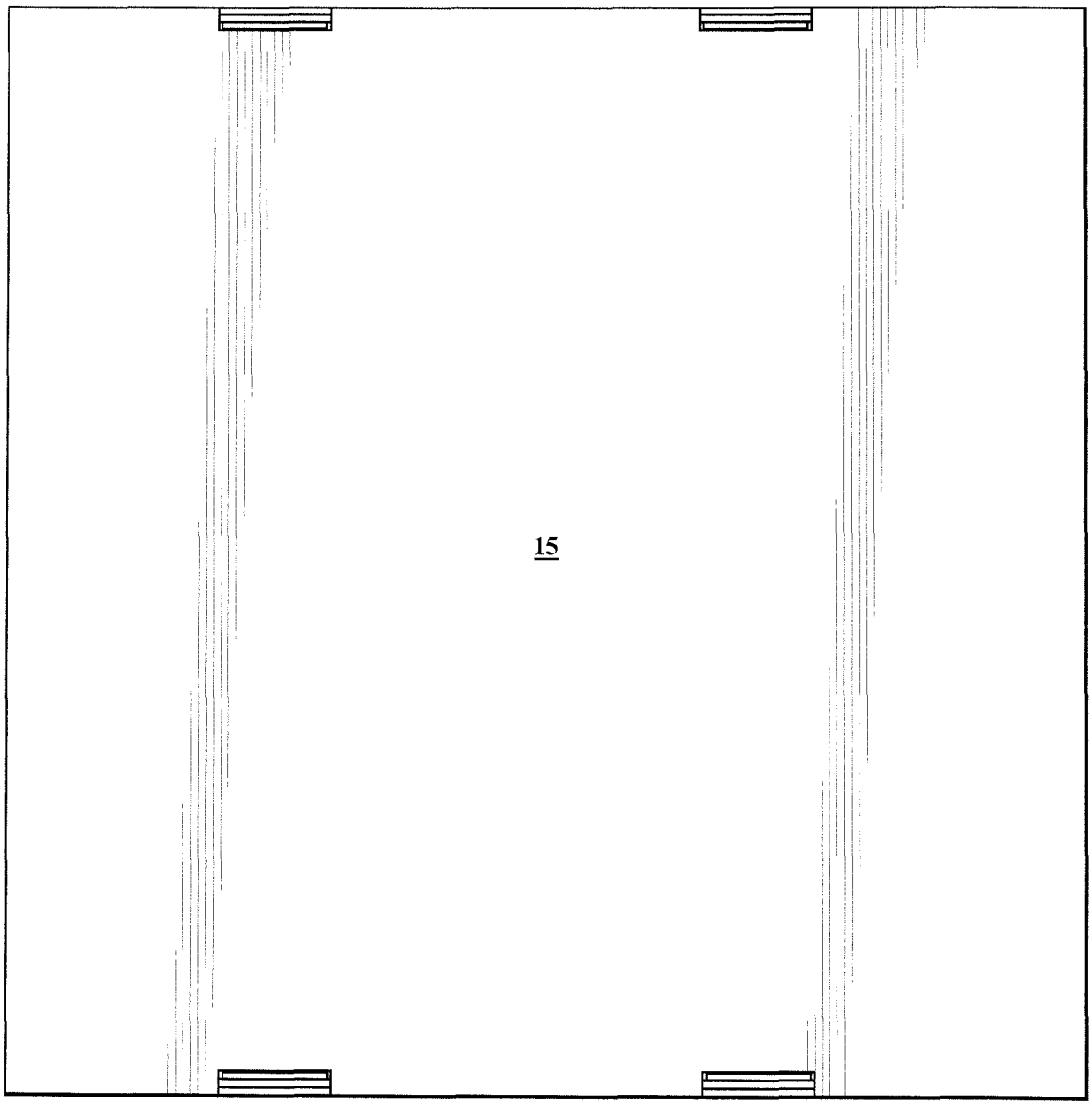
FIG. 9 is a bottom side plan view of the closed container according to one embodiment of the present invention.
Figure 10:
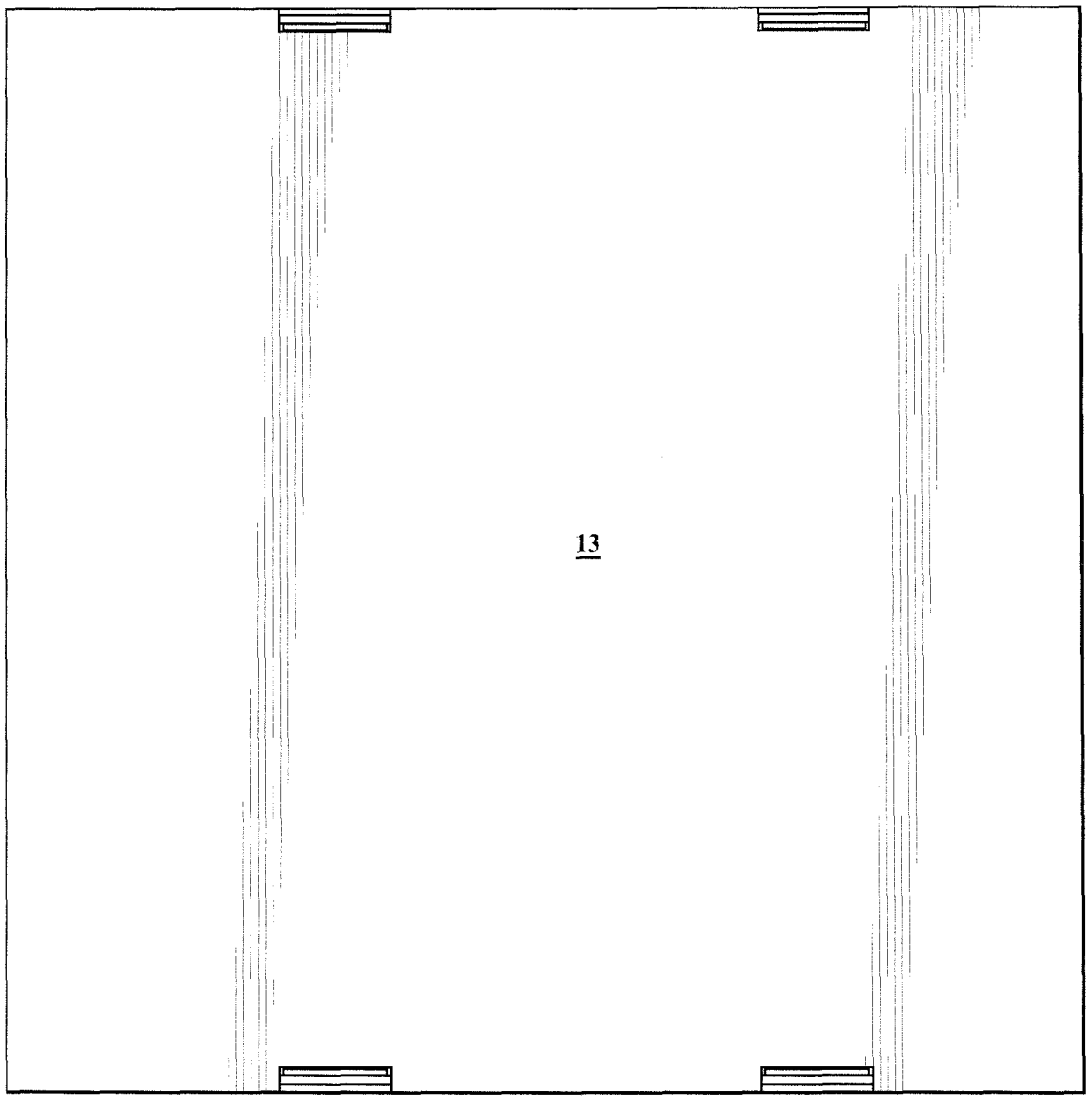
FIG. 10 is a top side plan view of the closed container according to one embodiment of the present invention.
Figure 16:
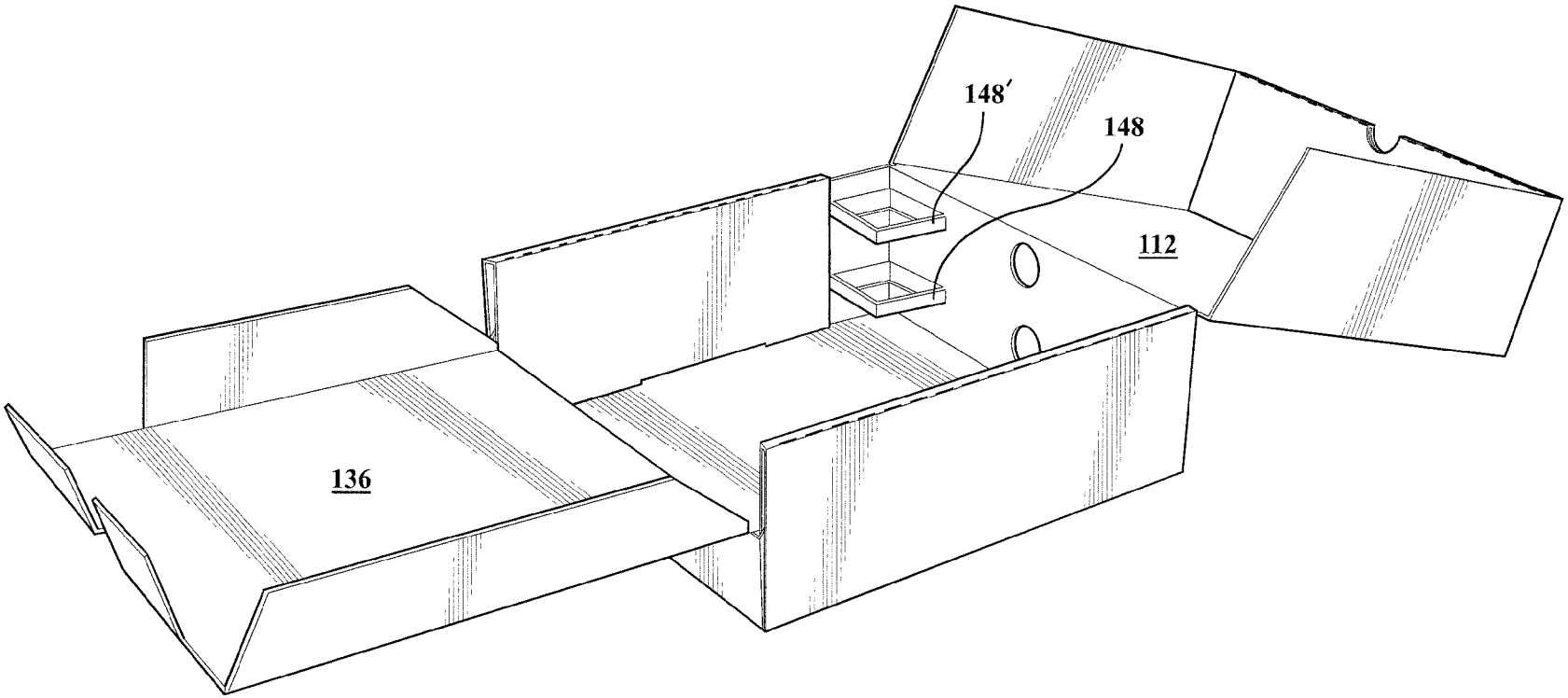
FIG. 16 is an angled side perspective view of an open container with two corner dividers folded out and the horizontal divider opened to show the bottom layer according to the second embodiment of the invention.
Figure 17:
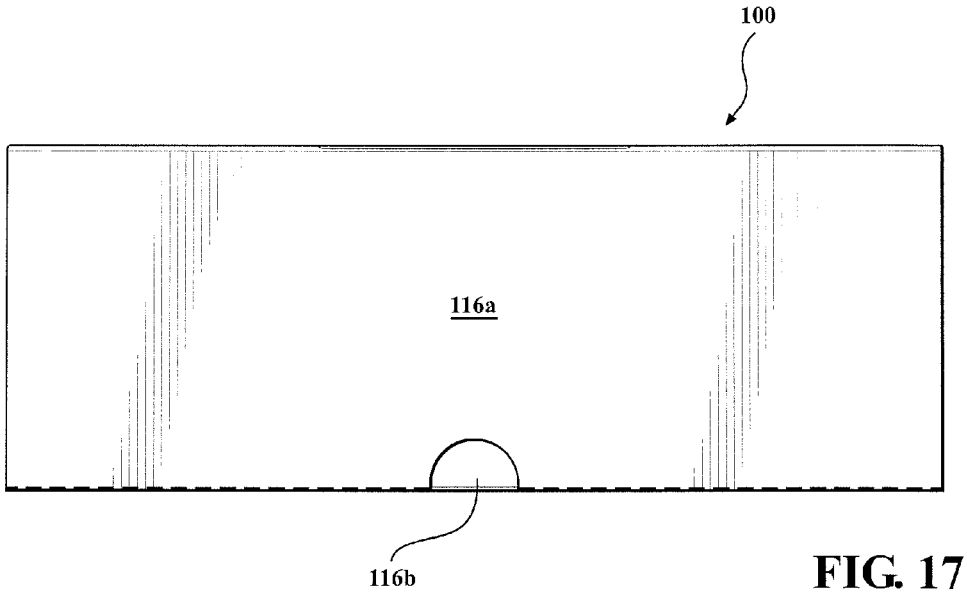
FIG. 17 is a front side plan view of the closed container according to the second embodiment of the invention.
Figure 18:
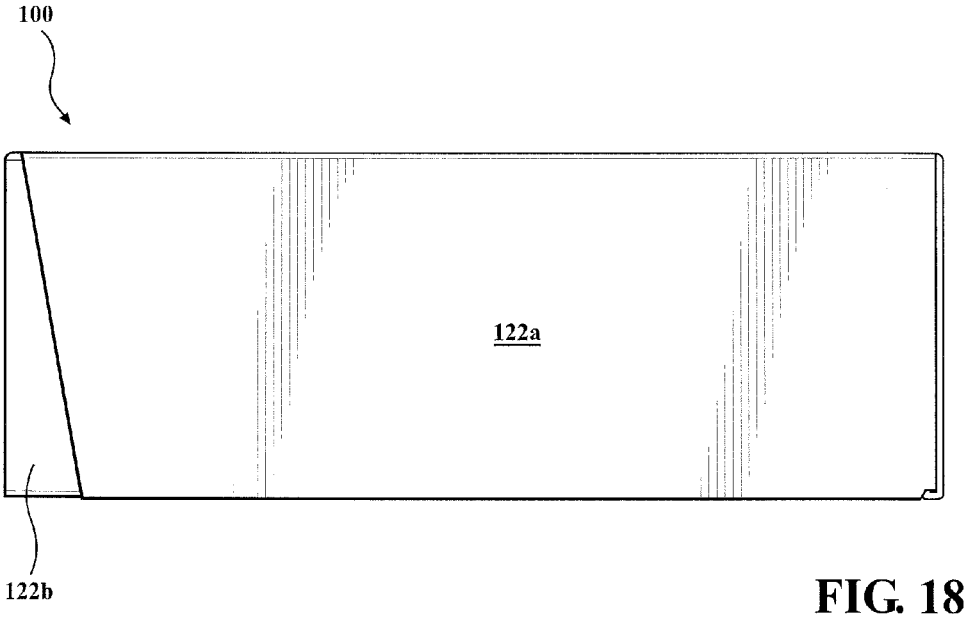
FIG. 18 is a left side plan view of the closed container according to the second embodiment of the invention.
Figure 19:
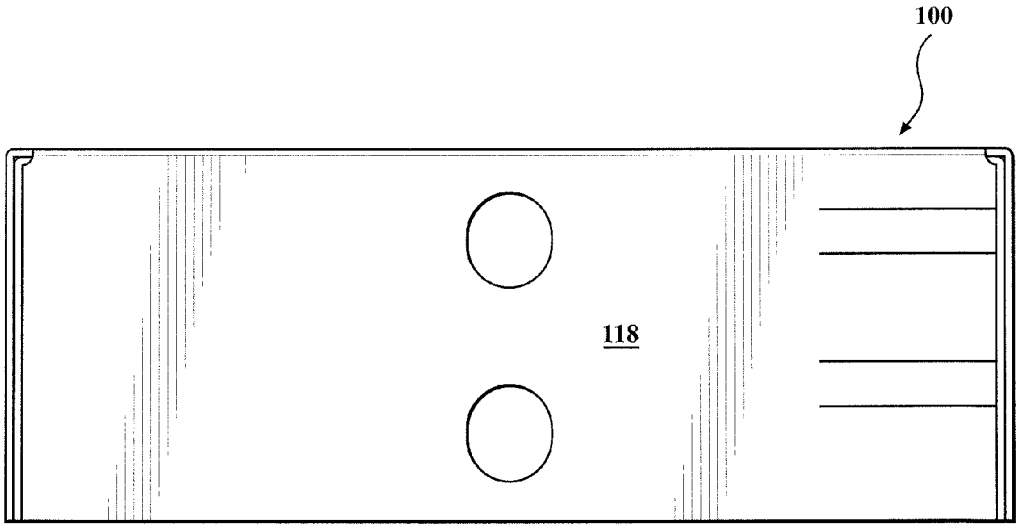
FIG. 19 is a rear side plan view of the closed container according to the second embodiment of the invention.

FIGS. 4, 11, and 16 show one or more sauce holders 48, 48', 148, 148' that extend from one of the respective bottom back side 18*b*, as is the case with sauce holder 48, or top back side 18*a*, as is the case with sauce holder 48', or back side 118. The sauce holders 48, 48', 148, 148' are selectively foldable from the respective top back side 18*a* or bottom back side 18*b*, or back side 118 and are integral with the container. The sauce holders 48, 48', 148, 148' extend between the top back side 18*a* and one of top left side 20*a* or top right side 22*a*, or bottom right side 22*b*, or compartment walls 132. The sauce holder 48 extends from the bottom back side 18*b* and the bottom left side 20*a* or bottom left side 20*b* or bottom right side 22*b*, such that when the sauce holders 48, 48' are extended, they create a holder for grasping a container, which can be used to hold pizza sauce, cheese or other side items. The sauce holders 48, 48', 148, 148' can be folded back to their undeployed position if it is not desired to use them.

Figure 23:
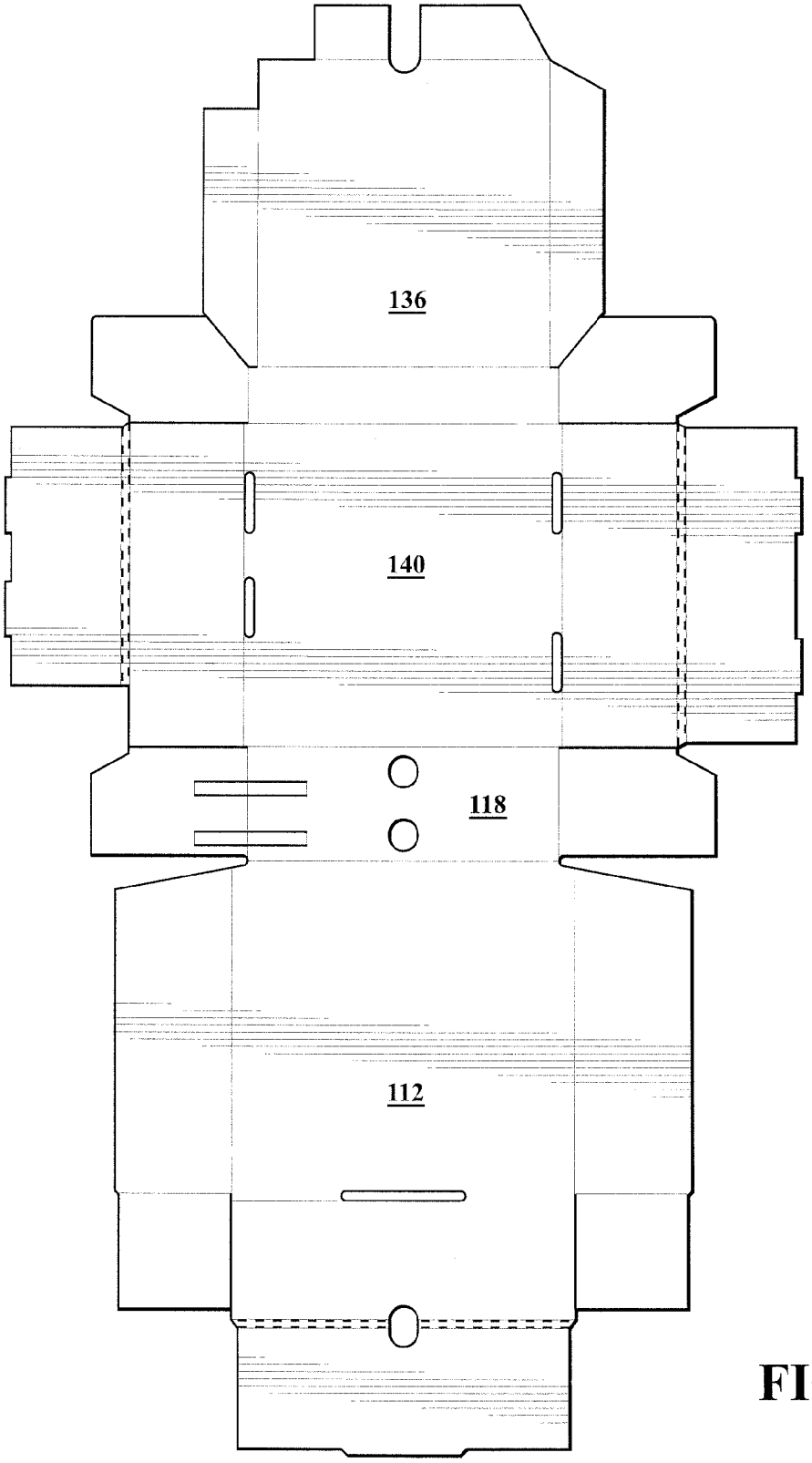
FIG. 23 is an overhead plan view of an unfolded blank of the container according to the second embodiment of the invention.
Figure 24:
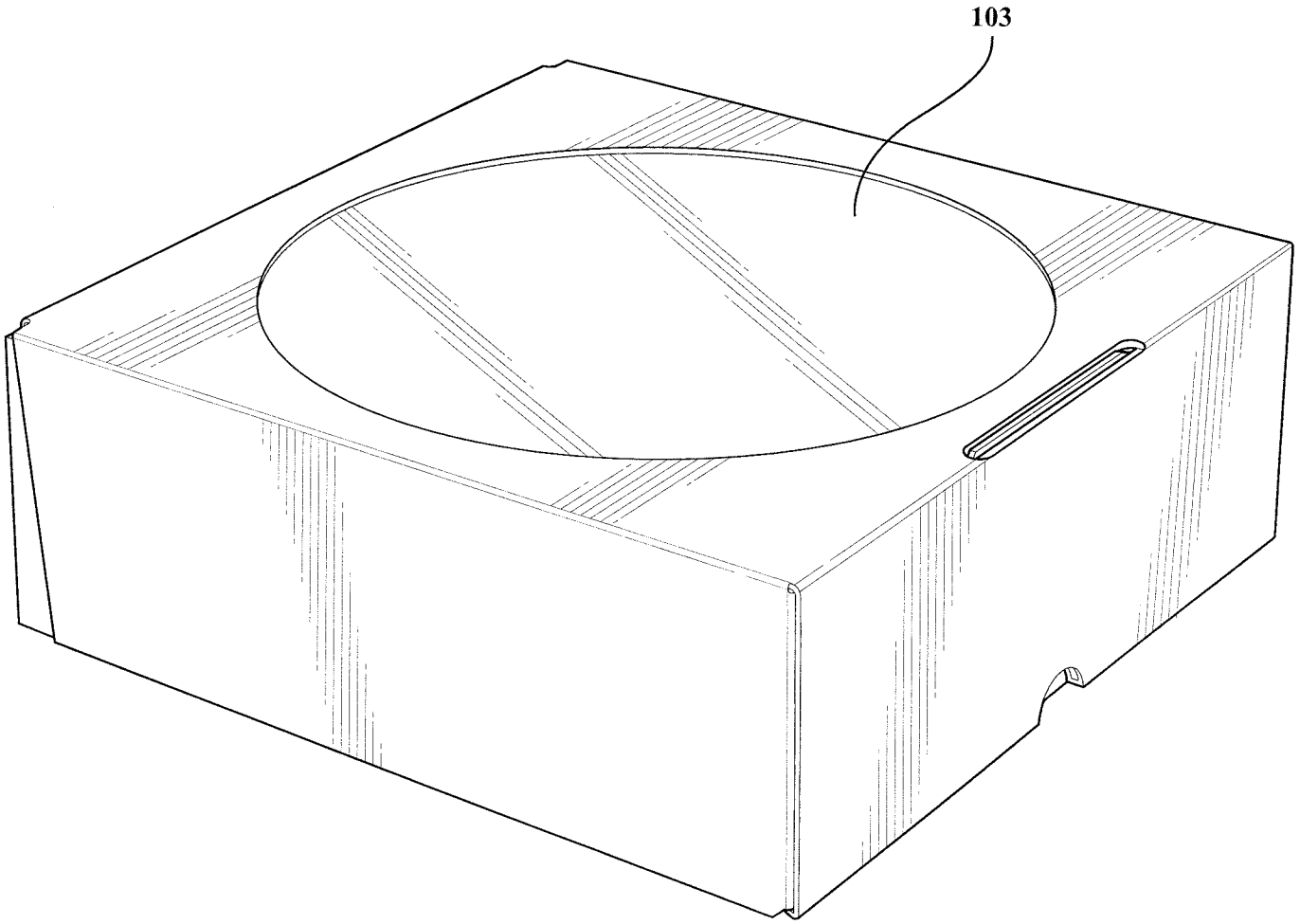
FIG. 24 is a side perspective view of another embodiment of the invention showing a viewing window formed on the top of the container.

FIG. 23 shows a flat blank that is the unfolded container in accordance with the present embodiment of the invention. The blank has several fold lines that are used to fold the various sides and portions of the container 100. FIG. 24 shows another alternate embodiment of the invention with a viewing window 103 formed on the top of the container.

While the present embodiment of the invention describes features that are on specific sides of the container it is within the scope of this invention for any features to be positioned on the opposite side top, bottom, left, right, front or back.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A container comprising:

a top having a planar top surface, a top front side, a top left side, a top right side, and a top back side;

a bottom having a planar bottom surface, a bottom front side, a bottom left side, a bottom right side, and a bottom back side;

a horizontal opening edge that extends parallel to the planar top surface and the planar bottom surface, said horizontal opening edge divides and separates the top front side from the bottom front side, the top left side from the bottom left side and the top right side from the bottom right side;

a back side horizontal fold extending longitudinally across and creating a fold line between the top back side and the bottom back side;

a horizontal divider connected to the bottom front side and foldable along a horizontal divider fold line, wherein the horizontal divider extends above and parallel to a bottom inside surface of the bottom of the multi-tiered container when the horizontal divider is folded along the horizontal divider fold line;

a locking tab formed on the top left side and extending downward and receivable in an aperture formed on the bottom left side;

a locking tab formed on the top right side and extending downward and receivable in an aperture formed on the bottom right side, wherein the locking tab on the top left side and the locking tab on the top right side hold the top to the bottom when the container is in the closed position; and a locator tab formed on the bottom left side and extending upward toward and received in a recess on the top left side, a locator tab formed on the bottom right side and extending upward and received in a recess formed on the top right side, wherein the locator tab of the bottom left side and the locator tab on the bottom right side function to align the top and bottom of the multi-tiered container when the multi-tiered container is in the closed position, in addition to preventing articles placed on the horizontal divider from sliding out of the multi-tiered container on the bottom left side or bottom right side, wherein the locator tab of the bottom left side and the locator tab of the bottom right side are positioned within recesses formed on an inside surface of the top of the container, which confirms alignment of the top and the bottom when the container is closed.

2. The multi-tiered container of claim 1, wherein the locator tab of the bottom left side and the locator tab of the bottom right side align partially parallel and substantially abut against the respective locking tab of the top left side and the locking tab of the top right side when the container is in the closed position, thereby providing support to the structure of the container by increasing the thickness of the container in the region of the locking tab of the top left side and the locator tab of the bottom left side, and the locking tab of the top right side and locator tab of the bottom right side.

3. The container of claim 1 wherein the locking tab of the top left side and the locking tab of the top right side each have a neck portion and a wing portion, wherein said wing portion is wider than the neck portion and the respective aperture of the bottom left side and the aperture of the bottom right side, wherein each wing portion locks the top to the bottom by passing through the respective aperture and resting laterally below the aperture.

4. The container of claim 1 further comprising one or more sauce holders extending from the bottom back side or the top back side of the container, wherein the one or more sauce holders are selectively foldable from the bottom back side or the top back side and are integral with the container.

5. The container of claim 4 wherein the one or more sauce holders extend between one of the bottom back side or the top back side and one of the top left side, bottom left side, top right side or bottom right side.

6. The container of claim 1 further comprising a divider positionable on a bottom inside surface of the container for dividing the bottom inside surface into sections.

7. The container of claim 1 further comprising a thumb hole formed in the horizontal divider allowing a user of the container to move the horizontal divider about the horizontal divider fold line using the thumb hole.

8. A container comprising:

a top having a planar top surface, a top front side, a top left side, a top right side, and a top back side;

a bottom having a planar bottom surface, a bottom front side, a bottom left side, a bottom right side, and a bottom back side;

a horizontal opening edge that extends parallel to the planar top surface and the planar bottom surface, said horizontal opening edge divides and separates the top front side from the bottom front side, the top left side from the bottom left side and the top right side from the bottom right side;

a back side horizontal fold extending longitudinally across and creating a fold line between the top back side and the bottom back side;

a horizontal divider connected to the bottom front side and foldable along a horizontal divider fold line, wherein the horizontal divider extends above and parallel to a bottom inside surface of the bottom of the multi-tiered container when the horizontal divider is folded along the horizontal divider fold line;

a locking tab formed on the top left side and extending downward and receivable in an aperture formed on the bottom left side;

a locking tab formed on the top right side and extending downward and receivable in an aperture formed on the bottom right side, wherein the locking tab on the top left side and the locking tab on the top right side hold the top to the bottom when the container is in the closed position; and a pull tab that extends along the horizontal divider fold line that allows the horizontal divider to be separated from the container when the pull tab is pulled and removed.

9. A container comprising:

a top having a planar top surface, a top front side, a top left side, a top right side, and a top back side;

a bottom having a planar bottom surface, a bottom front side, a bottom left side, a bottom right side, and a bottom back side;

a horizontal opening edge that extends parallel to the planar top surface and the planar bottom surface, said horizontal opening edge divides and separates the top front side from the bottom front side, the top left side from the bottom left side and the top right side from the bottom right side;

a back side horizontal fold extending longitudinally across and creating a fold line between the top back side and the bottom back side;

a horizontal divider connected to the bottom front side and foldable along a horizontal divider fold line, wherein the horizontal divider extends above and parallel to a bottom inside surface of the bottom of the multi-tiered container when the horizontal divider is folded along the horizontal divider fold line;

a locking tab formed on the top left side and extending downward and received by an aperture formed on the bottom left side;

a locking tab formed on the top right side and extending downward and receivable in an aperture formed on the bottom right side, wherein the locking tab on the top left side and the locking tab on the top right side hold the top to the bottom when the container is in the closed position;

a locator tab formed on the bottom left side and extending upward toward and received in a recess on the top left side, a locator tab formed on the bottom right side and extending upward and received in a recess formed on the top right side, wherein the locator tab of the bottom left side and the locator tab on the bottom right side function to align the top and bottom of the multi-tiered container when the multi-tiered container is in the closed position, in addition to preventing articles placed on the horizontal divider from sliding out of the multi-tiered container on the bottom left side or bottom right side;

wherein the locator tab of the bottom left side and the locator tab of the bottom right side are positioned within recesses formed on an inside surface of the top of the container, which confirms alignment of the top and the bottom when the container is closed and the locator tab of the bottom left side and the locator tab of the bottom right side align partially parallel and substantially abut against the respective locking tab of the top left side and the locking tab of the top right side when the container is in the closed position, thereby providing support to the structure of the container by increasing the thickness of the container in the region of the locking tab of the top left side and the locator tab of the bottom left side, and the locking tab of the top right side and locator tab of the bottom right side.

10. The container of claim 9 wherein the locking tab of the top left side and the locking tab of the top right side each have a neck portion and a wing portion, wherein said wing portion is wider than the neck portion and the respective aperture of the bottom left side and the aperture of the bottom right side, wherein each wing portion locks the top to the bottom by passing through the respective aperture and resting laterally below the aperture.

11. The container of claim 9 further comprising one or more sauce holders extending from the bottom back side or the top back side of the container, wherein the one or more sauce holders are selectively foldable from the bottom back side or the top back side and are integral with the container.

12. The container of claim 11 wherein the one or more sauce holders extend between one of the bottom back side or the top back side and one of the top left side, bottom left side, top right side or bottom right side.

13. The container of claim 9 further comprising a divider positionable on a bottom inside surface of the container for dividing the bottom inside surface into sections.

14. The container of claim 9 further comprising a thumb hole formed in the horizontal divider allowing a user of the container to move the horizontal divider about the horizontal divider fold line using the thumb hole.

15. The container of claim 9 further comprising a pull tab that extends along the horizontal divider fold line that allows the horizontal divider to be separated from the container when the pull tab is pulled and removed.

* * * * *